US006443744B1

(12) United States Patent
Weigel

(10) Patent No.: US 6,443,744 B1
(45) Date of Patent: Sep. 3, 2002

(54) GROUNDING CONTACT

(75) Inventor: Wilfried Weigel, Dautphetal (DE)

(73) Assignee: Schunk Metall und Kunststoff GmbH, Wettenberg (DE)

( * ) Notice: Subject to any disclaimer, the term of this patent is extended or adjusted under 35 U.S.C. 154(b) by 0 days.

(21) Appl. No.: 09/768,783

(22) Filed: Jan. 25, 2001

(30) Foreign Application Priority Data

Jan. 25, 2000 (DE) ..... 100 03 007

(51) Int. Cl.[7] ..... H01R 13/648; H01R 4/66; H01R 39/00

(52) U.S. Cl. ..... 439/92; 439/17

(58) Field of Search ..... 439/92, 16, 18, 439/27, 29

(56) References Cited

U.S. PATENT DOCUMENTS

| | | | | | |
|---|---|---|---|---|---|
| 3,937,542 | A | * | 2/1976 | Amundsen, Jr. | 339/3 |
| 4,451,105 | A | * | 5/1984 | Sakurai | 339/113 |
| 4,525,014 | A | * | 6/1985 | Holman et al. | 339/14 |
| 5,173,065 | A | * | 12/1992 | Herlache et al. | 439/741 |
| RE34,693 | E | * | 8/1994 | Plocek et al. | 439/15 |
| 5,924,871 | A | * | 7/1999 | Menz | 439/16 |
| 5,928,007 | A | * | 7/1999 | Lundback | 439/92 |
| 6,019,614 | A | * | 2/2000 | Blaur et al. | 439/92 |
| 6,027,348 | A | * | 2/2000 | Lai et al. | 439/92 |

FOREIGN PATENT DOCUMENTS

| | | |
|---|---|---|
| CH | 176524 | 8/1935 |
| DE | 1953043 | 5/1970 |
| DE | 81136 | 4/1971 |
| EP | 0582888 | 2/1994 |
| EP | 0805089 | 11/1997 |

* cited by examiner

*Primary Examiner*—P. Austin Bradley
*Assistant Examiner*—Edwin A. León
(74) *Attorney, Agent, or Firm*—Dennison, Schultz & Dougherty

(57) ABSTRACT

The invention relates to a grounding contact for transferring currents between fixed vehicle parts of a rail vehicle, such as an electric, diesel-electric or diesel-hydraulic locomotive or traction and traveling vehicle, and its rotating axis, including at least one contact element, such as carbon brushes (14), acted upon by pressure in the direction of the wheel axis, which lies or lie on a contact surface (10) originating indirectly or directly from the wheel axis, consisting in particular of carbon material or containing this, whereby the at least one contact element is acted upon by pressure through a flat element (30) in the direction of the contact surface. In order to ensure that the contact elements lie to a sufficient extent on the contact surface through simple construction methods and light construction with respect to weight, it is suggested that the flat element be an elastic layer (30) of elastomer material arranged in a mounting (20).

18 Claims, 2 Drawing Sheets

GROUNDING CONTACT

BACKGROUND OF THE INVENTION

The invention relates to a grounding contact for transmission of currents between fixed vehicle elements of a rail vehicle, such as an electric, diesel-electric or diesel-hydraulic locomotive or traction and traveling vehicle, and its rotating wheel axle, including at least one contact element, such as carbon brushes, which are acted upon by pressure in the direction of the wheel axis, which lies or lie on a contact surface containing or including carbon material originating indirectly or directly from the wheel axle, whereby at least the contact element is subjected to pressure through a flat element in the direction of the contact surface.

Operating and/or signal currents of rail vehicles can be guided through axle shafts and axle wheels to the rails, and therewith to the source of energy. The transmission from the fixed vehicle parts to the rotating axles takes place for this purpose with special current bridges which are usually designated as reverse current/grounding contacts.

The roller bearings of the axles can lie in the useful current circuit or parasitic current circuit. In order to protect them against passage of current and consequently against destruction, reverse current/grounding contacts must form a low resistance bridge. With a tension available through the bearing from, for example, 0.1–1 V (fritting voltage), the flow of current through the bearing begins. Associated with an irregularly rising amount of current, the value of the transition tension subsequently drops to ca. 0.5 V.

Reverse current/signal current/grounding contacts should produce a good and secure electric connection between the reverse current connection on the vehicle and the wheel axle on a defined current pathway in all operating situations of the vehicle. Furthermore, it must be assured that a constant transition resistance exists during signal transmission.

With a grounding contact known from DE-OS 1 953 043, a carbon brush is supported spring-prestressed, but not pivoting, in a housing originating on an axle of an electrical rail vehicle, which is braced in relation to a rotating contact disk. Here the carbon brush can either be pressed against a contact plate by means of a compression spring, or this can be pressed against the carbon spring by means of a tension spring. When using a compression spring, this can likewise originate from a disk which is directly connected with the axle.

A cleaning block not designed as a grounding contact is known from DD 81 136 which can be pressed on the running surface of the running surface of the wheel of a rail vehicle by means of a hydraulic or pneumatic cylinder.

An electric rail vehicle with a rubber-sprung driving wheel is known from CH 176 524. Here the work current is derived through a carbon brush which is pressed on a wheel tire such that the carbon brush at the same time acts as a cleaning block for the running surface of the wheel tire.

A further grounding contact is described in EP 0 582 888 A1. Here the contact surface on which the carbon brush is supported is made of or contains carbon material. In this way, there results, among other things, the advantage of a reduction of wear and tear in relation to other grounding contacts.

SUMMARY OF THE INVENTION

A grounding contact representative of its type can be gathered from EP 0 805 089 A2 (U.S. Pat. No. 5,924,871). Here the contact element is acted upon by means of a device filled with fluid or a liquid material. On the contact element side, the fluid is bounded by a membrane owing to which the advantage exists that the device acted upon by pressure lies on the contact element or elements such as carbon brushes even when area-wise differences in wear and tear are present such that the contact elements for their part lie on the contact surface to the necessary extent and flat. In connection with construction in this regard, it should be assured that the fluid or the material capable of flowing is enclosed such that the requisite action of pressure takes place.

Underlying the present invention is the problem of perfecting a grounding contact of the type mentioned at the beginning such that it can be guaranteed with simple construction measures and light construction with respect to weight that the contact elements lie upon the contact surfaces to a sufficient extent, whereby the sealings required according to the state of the art are to be avoided.

In accordance with the invention, the problem is solved in that the flat element is an elastic layer of elastomer material arranged on a mounting. At the same time, the flat element spans a plane which runs parallel or approximately parallel to the contact surface itself. With the elastomer material, it can, for example, be rubber sponge.

In particular, the flat element has the shape of a disk element which completely or almost completely covers the contact elements.

The mounting for the flat element itself is a pot-shaped constructed pressure plate whose circular edge encloses the flat element edgewise, and has recesses.

It is especially provided that the pressure plate in section is H-shaped, whereby the pressure plate consists of a peripheral wall forming a hollow cylinder and a partition running at a distance to its front walls, which is the support of the elastic layer. On the opposite side, spring elements can operate in the known manner in order to press the pressure plate with the elastic layer together with the contact elements onto the contact surface to the necessary extent.

Even if the elastic layer is preferably a disk element, this can if necessary be composed of segments, preferably in the form of circular sectors.

The elastic layer itself should have a hardness of preferably 20–60 Shore A, especially between 40 and 50 Shore A. Temperature resistance between −45° C. and +250° C., water tightness, resistence to oils, fats and paints, resistance to aging and electrical non-conductivity can further be mentioned as additional preferred material characteristics of the elastic partition. The E-module comes to ca. 40 $N/mm^2$. Silicon should be mentioned as an especially suitable material, which is tempered if necessary.

Owing to the fact that the mounting with the elastic partition can be constructed relatively lightly without having to allow for losses with respect to functional capacity, there results an exceptionally rapid reaction to the case of when a vehicle is tilted, so that the desired grounding is always assured.

Further details, advantages and features of the invention emerge not only from the claims, the features to be inferred from this (in isolation and/or in combination), but also on the basis of the description below of a preferred embodiment to be gathered from the drawings, wherein:

DETAILED DESCRIPTION OF THE INVENTION

Elements of a reverse current/signal current/grounding contact are represented in the figures by means of which its currents are to be transmitted between the fixed vehicle elements of a rail vehicle and its rotating axle. For this, a contact disk 10 preferably comprised of carbon material or containing this originates directly or indirectly from a non-represented rotational axis, on which a contact element 14 mounted in a mounting 12 originating from a fixed vehicle element lies which can consist of several carbon brushes which, regarded from the contact disk, have the form of a circular sector and can be set at a distance from one another through fixation or separation bars. To this extent, however, reference is made to known constructions. Also, for reasons of simplicity, carbon brushes will be mentioned instead of contact elements below.

Figure 1:
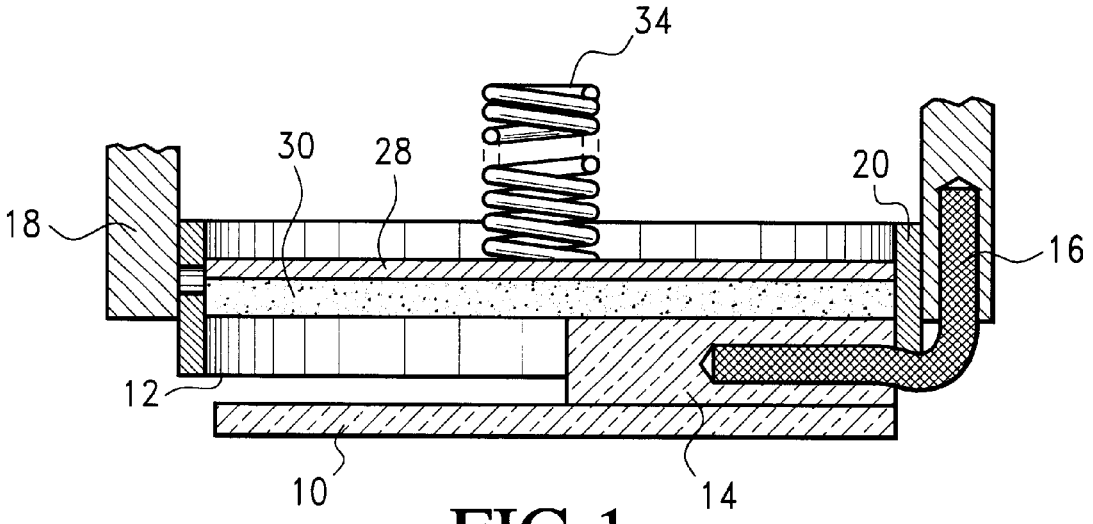
FIG. 1 Is a cross section through a section of the grounding contact.

As can be gathered from the section representation in accordance with FIG. 1, a current cable originates as a brush lead 16 which is or are fixed electrically conducting in a hollow cylinder 18 to be designated as a contact ring which at the same time can act as a bearing bushing. The contact ring 18 can then be fastened in a housing which is connected with the fixed rail vehicle element. Other usual fastenings or constructions are likewise conceivable.

Figure 4:
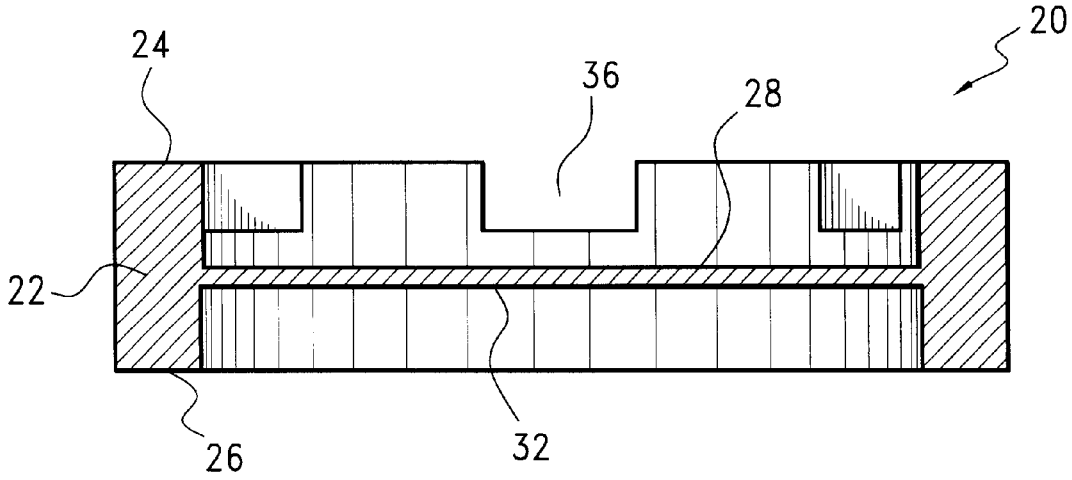
FIG. 4 Depicts a cross section of the mounting in accordance with FIG. 2 and 3.
Figure 3:
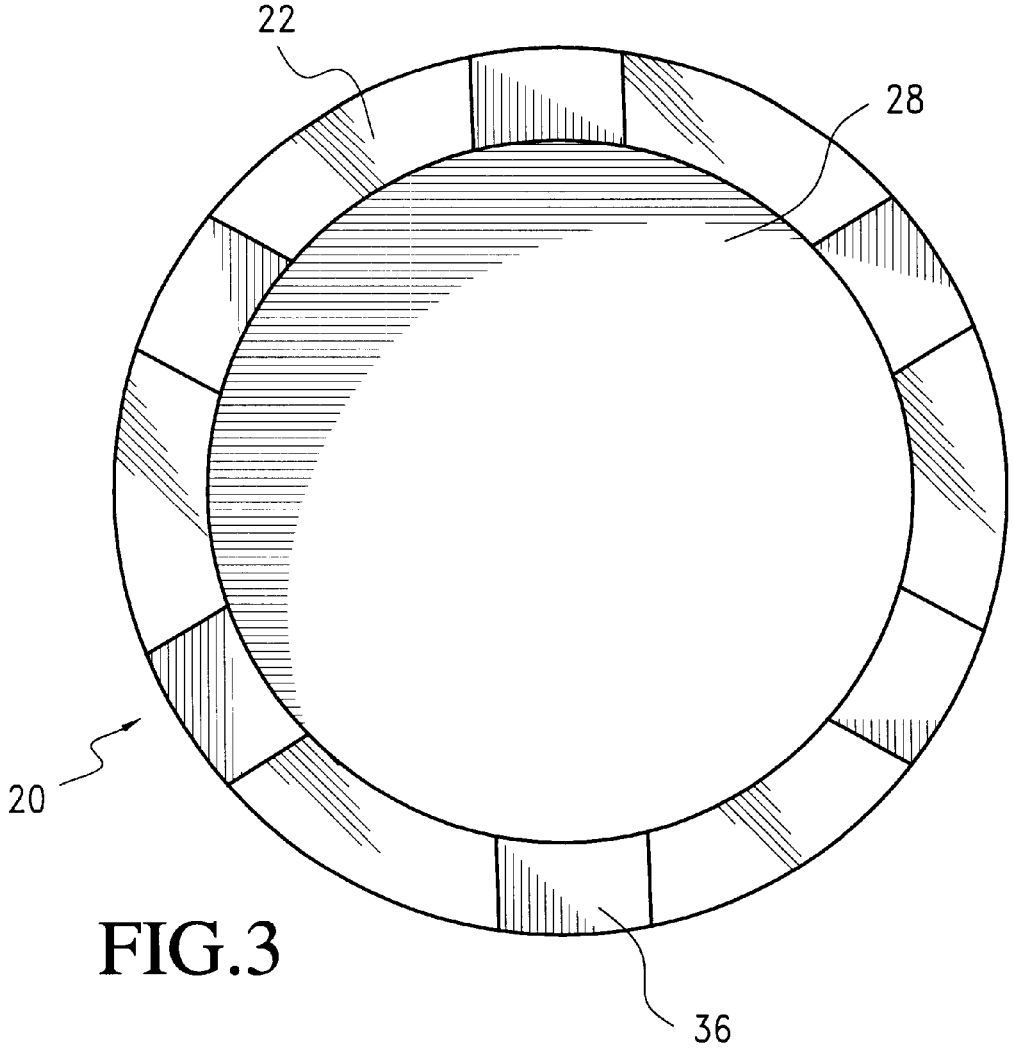
FIG. 3 Shows a plan view of the mounting in accordance with FIG. 2.

The following construction is selected in order to assure that the carbon brushes 14 lie on the contact disk 10 to the necessary extent and flat. Within the bearing bushing 18, a mounting 20 is provided which, corresponding to the representation in accordance with FIG. 4, consists of an outer wall 22 forming a hollow cylinder and a partition 28 running at a distance to the front edges 24, 26 of the wall 22 which is the support for an elastic layer 30, especially in the form of a silicon rubber plate which lies directly on the side of the carbon brushes 14 facing away from the contact surfaces. A spring element 34 acts on the partition 28, and on the area 32 lying opposite the elastic layer 30 in order to press the mounting 20 in the direction of the carbon brushes 14. Since the elastic layer 30 runs between the partition 28 and the carbon brush 14, it is assured that the force transmitted by the spring 34 or a like-acting element is evenly distributed on the carbon brushes 14 with the consequence that these lie flat on the contact disk 10.

Figure 2:
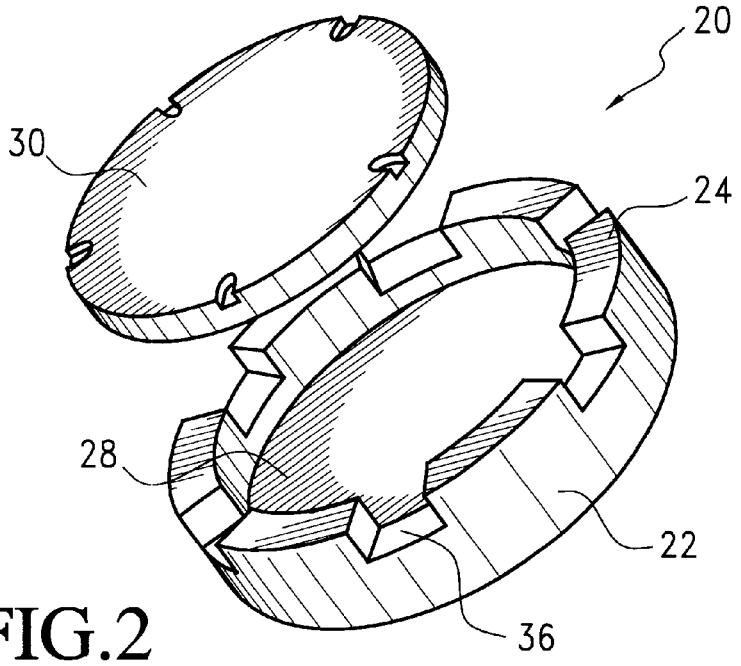
FIG. 2 Is an exploded representation of a mounting with elastic layer.

The construction of the mounting 20 is also to be gathered in particular from FIG. 2. One will recognize the mounting 20 which is comparable to a pot-shaped holding plate, whereby the elastic or layer 30 can be introduced into the region running between the outer wall 22 and the partition 28. The edge 24 of the outer wall 22 peripherally surrounding the elastic layer 30 has recesses 36 preferably distributed evenly on the periphery which serve for passage of current cables 16.

The elastic partition itself, which consists of silicon material, if necessary of tempered silicon material, should have a hardness between 30 and 50 Shore A. Furthermore, the following are to be indicated as preferable material properties:

Temperature resistance: −45° C. to +250° C.

Chemical resistance:

- watertight
- resistant against all commercially available oils, fats and paints, not electrically conducting
- resistant to aging, especially in connection with heat Material properties:

- Hardness preferable 20–60 Shore A, especially between 40 and 50 Shore A
- E-module ca. 40 N/mm$^2$

What is claimed is:

1. A grounding contact for transferring currents between fixed vehicle elements of a rail vehicle and its rotating axle, comprising:

at least one contact element, which lies or lie on a contact surface (10) originating indirectly or directly from the rotating axle, a mounting (20), a flat element being disposed within said mounting, wherein said at least one contact element is acted upon by pressure through said flat element in the direction of the contact surface, and wherein said flat element is an elastic layer made of elastomer material, and said mounting (20) is a pot-shaped constructed pressure plate having an H-shaped cross section, and said mounting comprises a wall forming a hollow cylinder and a partition for supporting said elastic layer disposed at a distance from front edges (24, 26) of said wall.

2. Grounding contact according to claim 1, characterized in that the elastic layer (30) spans a plane which runs parallel or approximately parallel to the contact surface (10).

3. Grounding contact according to claim 1, characterized in that the elastomer material is rubber sponge.

4. Grounding contact according to claim 1, characterized in that the elastomer material is a silicon material.

5. Grounding contact according to claim 1, characterized in that the elastomer material is a silicon-rubber material.

6. Grounding contact according to claim 1, characterized in that the elastomer material is made of tempered silicon material or silicon rubber material.

7. Grounding contact according to claim 1, characterized in that the elastic layer (30) is a disk element.

8. Grounding contact in accordance with claim 1, characterized in that the elastic layer (30) completely or almost completely covers the contact elements (14) facing away from the contact surfaces.

9. Grounding contact according to claim 1, characterized in that the partition (28) runs off center between the front edges (24, 26) of said wall.

10. Grounding contact according to claim 1, characterized in that the elastic layer (30) is a silicon rubber plate.

11. Grounding contact according to claim 1, characterized in that the elastic layer (30) is subdivided into segments.

12. Grounding contact according to claim 1, characterized in that the elastic layer (30) is subdivided into circular sector-like segments.

13. Grounding contact according to claim 1, characterized in that the elastic layer (30) has a temperature resistance between −45° C. and +250° C.

14. Grounding contact according to claim 1, characterized in that the elastic layer (30) is electrically insulating.

15. Grounding contact according to claim 1, characterized in that the elastic layer (30) is waterproof.

16. Grounding contact according to claim 1, characterized in that the elastic layer (30) is resistant against oils, fats and/or paint.

17. Grounding contact according to claim 1, characterized in that the material of the elastic layer (30) has an E-module of ca. 40 N/mm$^2$.

18. Grounding contact according to claim 1, characterized in that the material of the elastic layer (30) has a hardness of about 30–50 Shore A.

* * * * *